US011930945B1

(12) United States Patent
Ahmad

(10) Patent No.: US 11,930,945 B1
(45) Date of Patent: Mar. 19, 2024

(54) EASY SCOOP

(71) Applicant: Jordan Ahmad, Frisco, TX (US)

(72) Inventor: Jordan Ahmad, Frisco, TX (US)

( * ) Notice: Subject to any disclaimer, the term of this patent is extended or adjusted under 35 U.S.C. 154(b) by 202 days.

(21) Appl. No.: 16/915,265

(22) Filed: Jun. 29, 2020

Related U.S. Application Data

(60) Provisional application No. 62/867,325, filed on Jun. 27, 2019.

(51) Int. Cl.
*A47G 21/04* (2006.01)
*B65D 51/24* (2006.01)

(52) U.S. Cl.
CPC ..... *A47G 21/04* (2013.01); *B65D 51/246* (2013.01); *A47G 2200/106* (2013.01)

(58) Field of Classification Search
CPC . A47G 21/04; A47G 2200/106; B65D 51/246
USPC ..... 30/123
See application file for complete search history.

(56) References Cited

U.S. PATENT DOCUMENTS 9,187,224 B1 * 11/2015 Mazzilli ..... B65D 83/00
2012/0011727 A1 * 1/2012 Yang ..... A47J 43/283 30/150
2012/0205376 A1 * 8/2012 Yang ..... B65D 77/245 220/735
2014/0144912 A1 * 5/2014 Mazzilli ..... B65D 51/246 220/212
2014/0202917 A1 * 7/2014 Erlebach ..... B65D 51/246 206/553
2017/0121075 A1 * 5/2017 Gonzalez ..... B65D 83/06
2017/0209002 A1 * 7/2017 Scarpati ..... A47J 43/22
2017/0210507 A1 * 7/2017 Rule ..... B65D 77/245
2017/0265625 A1 * 9/2017 Thorpe ..... A45D 33/006
2019/0055073 A1 * 2/2019 Lee ..... B65D 51/246
2021/0007521 A1 * 1/2021 Arce ..... A01K 7/00

* cited by examiner

*Primary Examiner* — J. Gregory Pickett
*Assistant Examiner* — Niki M Eloshway
(74) *Attorney, Agent, or Firm* — Law Office of Jeff Williams PLLC; J. Oliver Williams

(57) ABSTRACT

The present invention discloses a food serving apparatus such as scoop designed to be magnetically mounted on top or underneath of a metallic lid of containers. The scoop comprises a bowl and a handle. The handle comprises a cavity, which includes at least two magnets separated by a small distance. The magnets are mounted within the cavity to hold the scoop on out side or in side of the metallic lid of the container. During the molding process, the molten plastic flows over and under the magnets to hold them in place in the cavity of the handle. The plastic encapsulated magnets in the handle avoids trapping of germs and other harmful biological microorganisms, thereby making the scoop very safe for storage on top surface or inside of the product container lids. Further, the scoop is made from food grade plastic material.

8 Claims, 6 Drawing Sheets

EASY SCOOP

BACKGROUND OF THE INVENTION

A. Technical Field

The present invention generally relates to utensils such as scoops. More specifically, the present invention relates to a scoop for magnetically attaching the same with the container lid to prevent the lose or misplacement of scoops.

B. Description of Related Art

Products such as bulk, free-flowing, liquid, powder and other substance are stored in a small, medium or large sized container to keep the items fresh and free of infection from pests and other vermin. The large storage containers have their issues with depletion from spoilage from weather and the pests. The smaller storage containers are usually taking place in the home and are used to store goods for accessibility to the consumer immediately or when needed.

Storing items such as grains, powders for drinks or other mixes, pasta, rice, and any number of things that are small and have many multiple pieces always requires some container to keep the items safe and organized. In the past, and in many cultures today the people are often turned to the use of baskets woven from grasses and leaves for the storage of food and other small loose or unpacked items. In most modern lifestyles, a wide range of food and different packaging devices such as bags and boxes, are applied for containing the bulk items.

Polymers such as low-density polyethylene creates many products in the form of plastic bags or plastic boxes for storing the products. Many popular manufacturers build a storage system to be used by the average household consumers. For instance, the manufacturers of Tupperware and Rubbermaid, are manufacture variety of storage systems that can be sealed or locked to keep items fresh and free of pests or spoilage. Long term storage usually requires the use of sheet metal to protect things from the elements such as germs and fungi. A common form of this metal type of storage is the biscuit tin or tin cracker box. The metal container is often preferred for its durability and its ability to seal out the light and to keeps pests from chewing through the container. Light is often harmful to long term storage of certain items including some food items.

The stored products are often removed conveniently from the container with the aid of utensil such as spoons or scoops. The storage of food or other items whether on the countertop or in a storage room or pantry often requires the use of scoop to either remove measured amounts or to transfer amounts of the item from the container to some other location. The containers that have proven to be most useful for keeping tiny objects such as grain and powders are often glass containers with metal lids. The metal lid is capable of maintaining an airtight seal, and the glass container is impervious to any pests such as ants, other insects, rodents and any number of creatures including certain bacteria. The use of scoop to remove measured amounts from the containers is a favoured means of accessing the items stored within the container.

The use of scoop brings with the issue of keeping the scoop available for use when removing goods from the container. Storing the scoop nearby or anywhere that is not in the immediate vicinity of the storage container, usually results in misplacing the scoop or the scoop becomes lost and must be replaced. The convenience of using a scoop to remove stored powders or other items from containers becomes an issue. The hunt for scoop is annoying and any convenience offered by the use of scoop is removed. In addition, when the user wishes to withdraw a portion of the product from the container, first the user needs to dig around in the interior of the container with their fingers to find the scoop.

Further, the scoop for any product, which is partially covered in the product in the container needs to get by the fingers. It needs to be cleaned up after serving and the hands must also be washed. In some cases, the scoop is stored in the kitchen drawer, where it must be located before the product can be removed from the container. In some extreme cases, no scoop can be located, and the user must substitute with an eating utensil and large amount of product being transferred from the container. All of these actions are time consuming and be irritating.

To resolve all the above-mentioned problems, there is a need for an effective scoop design to attach with the container lid. Further, there is a need for the scoop to prevent lose or misplacement of scoops.

SUMMARY OF THE INVENTION

The present invention generally discloses about holders for scoops. Further, the present invention discloses an improved scoop design for safely and securely attaching a scoop with the container lid and ready to use by preventing lose or misplacement of scoops.

According to the present invention, the easy scoop is an innovative food serving apparatus designed to be magnetically stored on top or underneath of metal lids of containers, thereby allowing the scoop to be retrieved, used and restored on or in the container lid. The scoop comprises a bowl and a handle. In one embodiment, the handle comprises a housing or a cavity. The cavity comprises at least two magnets to hold the scoop on or in the container lid. In one embodiment, the container lid is a ferrous metallic lid. In one embodiment, the scoop is a food grade plastic scoop. In one embodiment, the scoop is made of food grade plastic. In some embodiments, the scoop is made from any of the suitable material including, but not limited to, food grade silicon rubber, silver, aluminum, or other suitable, durable not-toxic materials. The scoop can be on the inside of the lid or on the outside of the lid.

In one embodiment, the magnets are thin and molded permanent magnets. The magnets could be easily located on the cavity of the handle, thereby raising the magnets inside the cavity to hold the scoop on or in the lid. The raised magnets in the handle are totally encapsulated in molded plastic so no germs and other harmful biological microorganisms can be trapped, making the scoop very safe for storage on the inside of the product container. In one embodiment, the molded food grade plastic scoop with strong magnets in the handle grip on to or under any ferrous metallic lid.

Further, the handle comprises a hole, which is used to hang up on a hook between uses. The food grade plastic is easy to clean and the sealed magnets prevent any intrusion of germs and other harmful biological microorganisms. In some embodiments, at least ⅛ cup scoop is made from food grade plastic, which is easy to use, store, wash and dry between uses.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
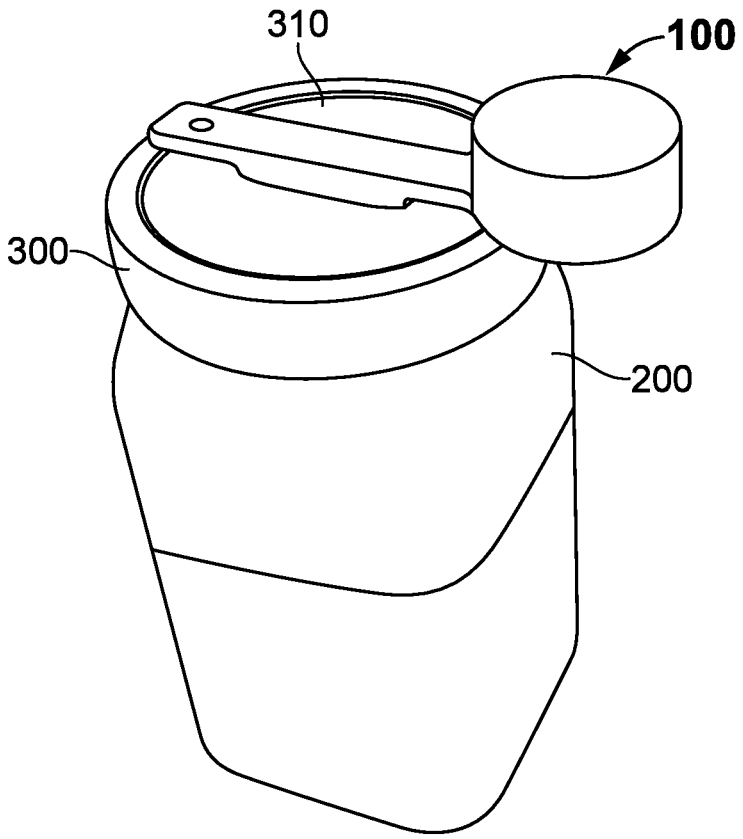
FIG. 1 shows a perspective view of a scoop retained on the top of metal lid of a container in an embodiment of the present invention.

Referring to FIG. 1, a perspective view of a utensil such as a food serving apparatus or a scoop 100 retained on top or outer side 310 of lid or closure 300 of a container 200 is disclosed, according to an embodiment of the present invention. The scoop 100 is an innovative product designed to keep the scoop 100 on any of the container lid 300, thereby preventing the lose or misplacement of scoops 100. The scoop 100 is positioned on the lid with flat top surface 310. The scoop could be used with the lid comprising a top projection (not shown in figure) such as lid holder to hold the lid 300 for opening and closing of container, where the scoop 100 is positioned over either side of the lid holder. In one embodiment, the lid 300 is a ferrous metal lid.

Figure 2:
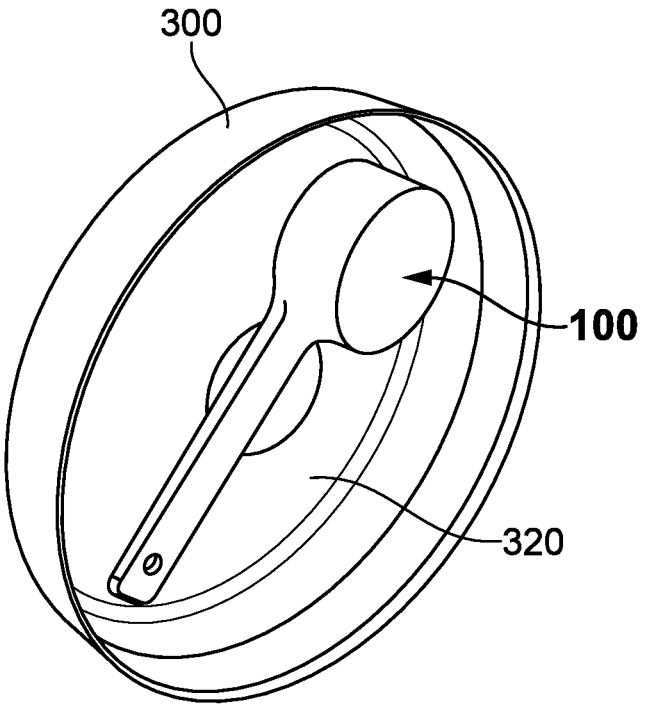
FIG. 2 shows a perspective view of the scoop retained underside of metal lid in one embodiment of the present invention.

Referring to FIG. 2, a perspective view of the scoop 100 retained underside or inside 320 of the metal lids 300 is disclosed, according to one embodiment of the present invention. The improved scoop design makes the scoop 100 to be safely and securely attached with either sides (310 and/or 320) of the metallic container lid 300, thereby by preventing lose or misplacement of scoops 100. In one embodiment, the scoop 100 is a food grade plastic scoop.

Figure 3:
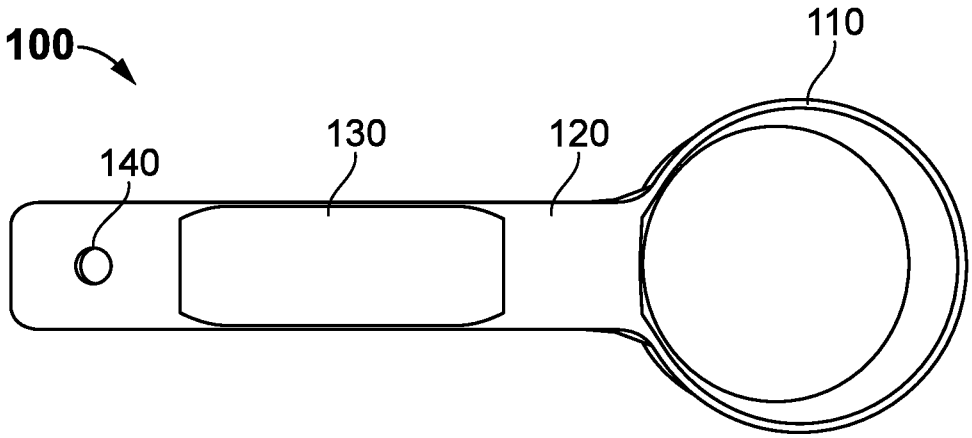
FIG. 3 shows a top view of the scoop in one embodiment of the present invention.
Figure 4:
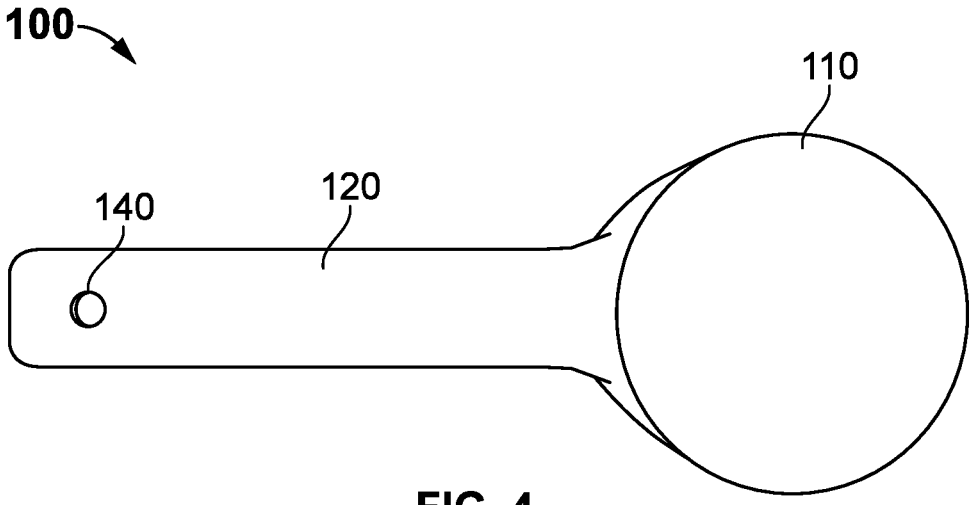
FIG. 4 shows a rear view of the scoop in one embodiment of the present invention.
Figure 5:
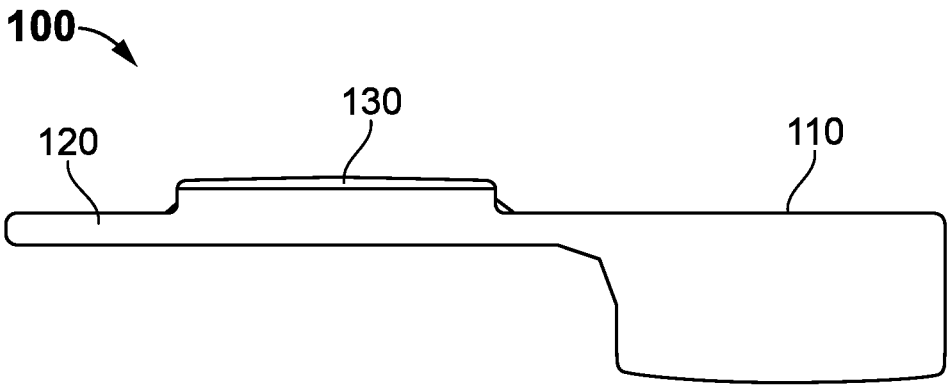
FIG. 5 shows a front view of the scoop in one embodiment of the present invention.

Referring to FIGS. 3, 4 and 5, a top view, a rear view and a front view of the scoop 100 is disclosed respectively, according to one embodiment of the present invention. The scoop 100 comprises a bowl or basket 110 and a handle 120, wherein the handle 120 is molded as a part of the bowl 110 to make a very durable scoop 100 with a long product life. In one embodiment, the bowl 110 is in circular shape with flat bottom. The scoop 100 is designed with the bowl 110 size at ⅛ of a cup, which is used for coffee makers, smoothie supplies, etc. In some embodiments, the bowl 110 could have any of the suitable shape includes, but not limited to rectangular, square or triangular shaped scoop with flat or rounded bottom.

In one embodiment, the handle 120 comprises a housing or a cavity 130. The cavity 130 comprises at least two magnets 150 to hold the scoop 100 on or in the container lid 300. The magnets 150 are positioned to allow the scoop 100 to be held to be stationary in a place on top surface 310 or under surface 320 of steel lids 300. In one embodiment, the scoop 100 is made of food grade plastic. In some embodiments, the scoop 100 is made from any of the suitable material including, but not limited to, food grade silicon rubber, silver, aluminum, or other suitable, durable not-toxic materials used in food processing methods. Further, the handle 120 comprises a hole 140 at one distal end, which is used to hang up on a hook while not in use. The other end of the handle 120 is molded with the bowl 110.

Figure 6:
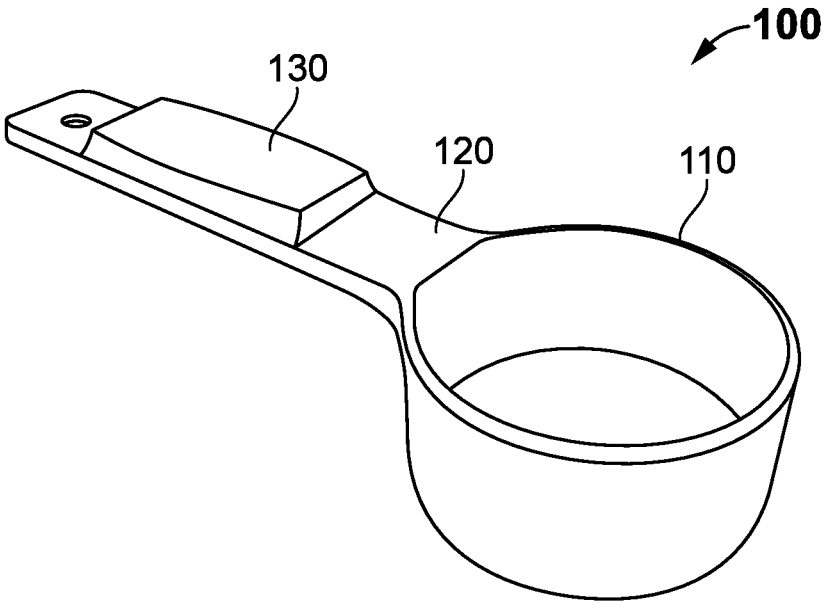
FIG. 6 shows a perspective view of the scoop in one embodiment of the present invention.

Referring to FIG. 6, a perspective view of the scoop 100 with embedded magnet 150 is disclosed, according to an embodiment of the present invention. the scoop 100 is molded in one piece using food grade material. In one embodiment, the food grade material is a food grade polyethylene plastic. In another embodiment, the scoop 100 is constructed with any of suitable non-toxic durable plastic, which is not harmful to the stored food product, metallic lids 300 or other surfaces of the container 200. In some embodiments, the food grade polyethylene plastic of plurality of colors are used. The scoop 100 made from food grade plastic, is easy to use, store, wash and dry between next usages.

Figure 7:
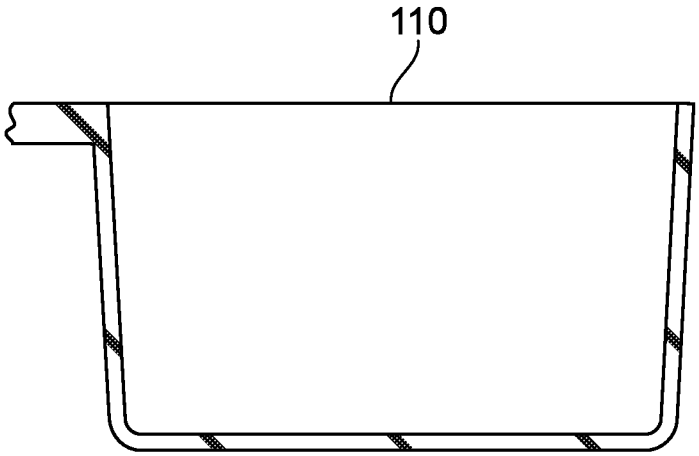
FIG. 7 shows a sectional view of scoop bowl in one embodiment of the present invention.

Referring to FIG. 7, a sectional view of the scoop bowl 110 is disclosed. In one embodiment, the bowl 110 has a pre-defined diameter and volume. In one embodiment, the bowl has the size of at least ⅛ of cup used in coffee makers. In some embodiments, the bowl 110 could have any of the suitable shape includes, but not limited to rectangular, square or triangular shaped scoop with flat or rounded bottom. The food grade, low-density polyethylene plastic used for the manufacturing of scoop 100, is especially formulated to meet food contact standards while providing an easy to clean and stain resistant surface. The food grade plastic is easy to clean and the sealed magnets prevent any intrusion of germs and other harmful biological microorganisms. Further, the handle 120 has a thickness of about 0.100" and the bowl 110 wall has the thickness of about to provide the strength required during use.

Figure 8:
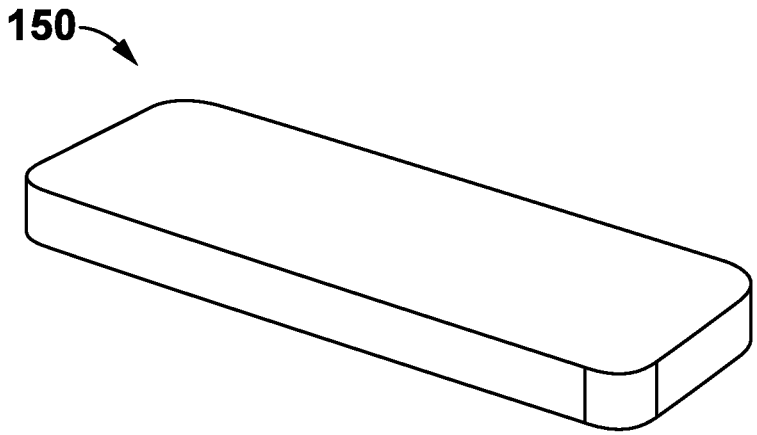
FIG. 8 shows a molded magnet in one embodiment of the present invention.

Referring to FIG. 8, a perspective view of the molded magnet 150 is disclosed. In one embodiment, the magnet 150 is mounted into the cavity or housing 130 provided in the handle 120. In one embodiment, the cavity 130 could have at least two magnets 150. In one embodiment, the magnets 150 are thin and molded permanent magnets. The magnets 150 could be easily located on the cavity 130 of the handle 120, thereby positioning the magnets 150 inside the cavity 130 to hold the scoop 100 on the upper side 310 or inner side 320 the lid 300 as shown in FIGS. 1 and 2. In one embodiment, the food grade plastic scoop is designed to be magnetically stored on the top 310 or underneath 320 of ferrous metal lids 300, which enables easy retrieving, usage and re-storing of the scoop 100 with the container 200.

Figure 9:
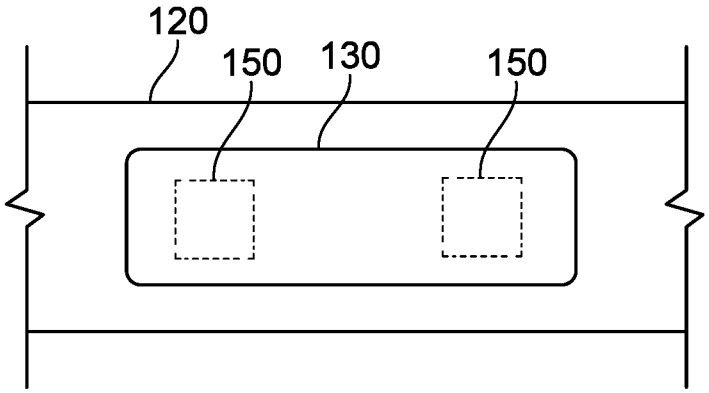
FIG. 9 shows a cross-sectional view of the molded magnet in one embodiment of the present invention.

Referring to FIG. 9, a cross-sectional view of the molded magnets 150 in the handle 120 is disclosed, according to one embodiment of the present invention. The raised magnets 150 in the handle 120 are totally encapsulated in molded plastic, thereby avoiding trapping of germs and other harmful biological microorganisms, which makes the scoop 100 very safe for storage on top surface 310 or inside 320 of the product container lids 300. In one embodiment, the molded food grade plastic scoop 100 with strong magnets 150 in the handle 120 grips on upper side 310 or under side 320 of any ferrous metallic lid 300 as shown in FIGS. 1 and 2.

In one embodiment, the two magnets 150 are square neodymium magnets molded into the handle 120. The magnets 150 are mounted in the cavity 130 having the size of about 0.25" square and molded into the cavity 130 of about 0.025" below the upper surface of the handle 120 to allow the maximum pull, while sealing the components within. Each magnet 150 exerts a maximum pull of about 0.61 pounds and total of about 1.22 pounds, which is more than sufficient to hold the scoop 100 in place when it is not being used. The magnets 150 are supported at the desired position in the plastic mold or handle 120 using an internal support or cavity 130. During the molding process, the molten plastic flows over and under the magnets 150 to hold them in place in the finished product 100. The 0.031" thick magnets 150 are totally enclosed with the plastic mold by the end of the injection cycle. The molded-in magnet 150 prevents the magnet to be separated from the scoop 100 and keeps the lines of the scoop 100 clean and preventing any build-up of debris or dirt from occurring.

The food grade plastic scoop 100 of the present invention is fabricated, but not limited to, the following materials and processes. The scoop 100 is injection molded using food-grade polyethylene plastic with the magnets 150 molded within the cavity 130 of the handle body 120. In an embodiment, the plastic is a preferred plastic used within the food packaging industry. The selected food grade plastic has a very simple molecular structure that does not require any contaminants for processing. It is recommended by environmental groups all over the world. The plastic is easy to clean and is highly resistant to staining. The scoop 100 could be supplied in almost any vibrant color, so a distinctive color may be chosen to enhance the product recognition factor, which can dramatically improve the market adoption of the product 100.

The raised magnets 150 in the handle 120 are totally encapsulated in molded plastic. It eliminates trapping of any germs and other harmful biological microorganisms during use or storage, which makes the scoop 100 very safe for fastening outside 310 or inside 320 of metallic lid 300 of the product container 200. After molding, the logo is hot stamped into the handle 120 using food-grade paints. The magnet 150 adheres the scoop 100 to any metal container lid 300 for keeping the scoop 100 visible and always with the container 200.

In one embodiment, the scoop 100 has at least two magnets mounted in the cavity 130 provided in the handle body. The magnets 150 are strong neodymium magnets having the size of about 0.25" square by 0.031" thickness. The two magnets 150 are mounted just under the skin of plastic handle 120 and sealed. The sealing of magnets is not solely affecting the pull strength of the magnets 150. Each magnet exerts a pull of 0.61 pounds, for a total of 1.22 pounds and are raised to allow for the support of rest of the scoop 100 on or in the surface of the lid 300 for easy grasping for use. Use of the two square magnets 150 separated by a small distance, holds the scoop 100 parallel to the surface of the lid 300 and is less expensive than using a single longer rectangular magnet.

The food grade plastic scoop of the present invention is designed to be aesthetic and effective in the application. The relative ease of manufacture and the moderately inexpensive components provide good marketability for the manufacturer. Further, the user benefits from the improved access and storage of scoop, which provides considerable market interest in the product. In addition, the raised magnets in the handle are totally encapsulated with molded plastic, which makes the scoop very safe for storage with the container lids. The molded food grade plastic scoop with strong magnets in the handle grips on ferrous metallic lid. Further, the scoop is safely and securely attached to the container lid and ready to use, thereby preventing the lose or misplacement of scoops. The scoops could be in various colors and sizes to meet the user requirements. The food grade plastic scoop is good for food related items or other items stored in the container. The smooth design of scoop prevents the buildup of debris and/or dirt.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. A food serving apparatus to be stored on a lid of a container, comprising:

a scoop configured to be retrieved, used, and stored on the lid of the container;

a holder to magnetically hold the scoop;

wherein the scoop includes a bowl and a handle, the bowl having an opening flush with a first surface of the handle;

wherein the handle includes a housing for defining a cavity;

wherein the cavity includes a first neodymium magnet and a second neodymium magnet to magnetically attach the housing to the lid of the container, the magnet located on the first surface so as to locate the opening of the bowl adjacent the container when stored;

wherein the handle has a thickness of about 0.100".

2. A food serving apparatus to be stored on a lid of a container as in claim 1, wherein the lid is a ferrous metallic lid.

3. A food serving apparatus to be stored on a lid of a container as in claim 2, wherein the first magnet and the second magnet are molded permanent magnets.

4. A food serving apparatus to be stored on a lid of a container as in claim 2, wherein the first magnet and the second magnet are totally encapsulated in molded plastic.

5. A food serving apparatus to be stored on a lid of a container as in claim 1, wherein the scoop is formed from at least one of food grade silicon rubber, silver, or aluminum.

6. A food serving apparatus to be stored on a lid of a container as in claim 1, wherein the scoop is positioned on the inside of the lid.

7. A food serving apparatus to be stored on a lid of a container as in claim 1, wherein the scoop is positioned on the outside of the lid.

8. A food serving apparatus to be stored on a lid of a container as in claim 1, wherein the handle includes a hole to hang the scoop.

* * * * *